US011247094B2

(12) United States Patent
Bear et al.

(10) Patent No.: US 11,247,094 B2
(45) Date of Patent: Feb. 15, 2022

(54) FREE WEIGHT STABILIZER BAR

(71) Applicants: Morris R. Bear, Centerville, IA (US); Patrick A. Morris, Albion, IA (US)

(72) Inventors: Morris R. Bear, Centerville, IA (US); Patrick A. Morris, Albion, IA (US)

( * ) Notice: Subject to any disclaimer, the term of this patent is extended or adjusted under 35 U.S.C. 154(b) by 186 days.

(21) Appl. No.: 16/699,691

(22) Filed: Dec. 1, 2019

(65) Prior Publication Data

US 2020/0121974 A1 Apr. 23, 2020

Related U.S. Application Data

(63) Continuation-in-part of application No. 15/856,230, filed on Dec. 28, 2017, now Pat. No. 10,583,319.

(51) Int. Cl.
*A63B 21/078* (2006.01)
*A63B 21/072* (2006.01)
(Continued)

(52) U.S. Cl.
CPC ..... *A63B 21/0783* (2015.10); *A63B 21/075* (2013.01); *A63B 21/0724* (2013.01); *A63B 21/154* (2013.01); *A63B 2225/093* (2013.01)

(58) Field of Classification Search
None
See application file for complete search history.

(56) References Cited

U.S. PATENT DOCUMENTS 4,249,726 A * 2/1981 Faust ..... A63B 21/00181 482/104
4,357,010 A * 11/1982 Telle ..... A63B 21/00072 482/113
(Continued)

*Primary Examiner* — Sundhara M Ganesan
*Assistant Examiner* — Shila Jalalzadeh Abyaneh
(74) *Attorney, Agent, or Firm* — Zarley Law Firm, P.L.C.

(57) ABSTRACT

A free weight bar stabilizer, to be used with a standard sized bar and attached barbell plates. The stabilizer includes a beam pivotally attached to a frame at a pivot point so that it is angularly movable in an arc between a raised position and a lower position, and a bar carriage attached to the beam so that it is linearly movable radially out from the pivot point between a retracted position and an extended position. The bar carriage includes spaced distal arms with attachment points for attaching the bar to support its opposing ends. The bar is thus freely movable within an envelope defined by the ranges of the simultaneous angular movement of the beam and the linear movement of the attachment points on the carriage. The free weight bar stabilizer may also include a counterweight carriage that simultaneously moves on the beam in the opposite direction of the bar carriage to counterbalance the weight of the bar carriage, so it does not add to the quantity of the weight being lifted and reduces push and pull of the bar carriage. Further, the bar stabilizer may include an assisting weight mechanism to assist when working heavy negatives, by providing a counterweight to reduce the actual weight being lifted at a predetermined point as the beam moves towards the lower position. An alternate embodiment of the bar stabilizer includes pivoted main beams that are formed by spaced parallel rails that receive the bar and counterweight carriages in the spacing between the rails. This provides a clean, uncluttered design that maximizes the open area available to the lifter in the vicinity of the bar.

16 Claims, 8 Drawing Sheets

(51) Int. Cl.
*A63B 21/00* (2006.01)
*A63B 21/075* (2006.01)

(56) References Cited

U.S. PATENT DOCUMENTS 4,406,452 A * 9/1983 Lapcevic ..... A63B 21/0615 482/104
4,746,115 A * 5/1988 Lahman ..... A63B 21/00072 482/113
4,858,915 A * 8/1989 Szabo ..... A63B 21/00072 482/97
5,108,095 A * 4/1992 Nichols ..... A63B 21/0615 482/137
5,116,297 A * 5/1992 Stonecipher ..... A63B 21/0615 482/137
5,217,422 A * 6/1993 Domzalski ..... A63B 21/154 482/100
5,314,394 A * 5/1994 Ronan ..... A63B 21/0626 482/104
6,261,205 B1 * 7/2001 Elefson ..... A63B 21/00181 482/135
6,482,139 B1 * 11/2002 Haag ..... A63B 21/0552 482/121
7,104,936 B2 * 9/2006 Karlstrom ..... A63B 21/0083 482/112
7,462,141 B1 * 12/2008 Raboin ..... A63B 21/225 482/110
7,488,277 B1 * 2/2009 Knapp ..... A63B 21/078 482/104
8,172,731 B1 * 5/2012 Bredda ..... A63B 23/03525 482/94
8,740,760 B2 * 6/2014 York ..... A63B 21/078 482/104
8,968,164 B2 * 3/2015 Giannelli ..... A63B 23/02 482/102
9,511,258 B2 * 12/2016 Hoole ..... A63B 21/0615
2005/0148445 A1 * 7/2005 Carle ..... A63B 21/4035 482/97
2006/0040800 A1 * 2/2006 Slyter ..... A63B 21/078 482/94
2009/0192026 A1 * 7/2009 Mason ..... A63B 21/4005 482/97
2014/0080685 A1 * 3/2014 Butler ..... A63B 21/00072 482/102
2014/0256516 A1 * 9/2014 Calderone ..... A63B 23/03525 482/98
2016/0114205 A1 * 4/2016 Giunchi ..... A63B 21/0628 482/127
2019/0275363 A1 * 9/2019 Jones ..... A63B 21/0615

* cited by examiner

FREE WEIGHT STABILIZER BAR

CROSS-REFERENCE TO RELATED APPLICATIONS

This application is a Continuation-In-Part Application of U.S. patent application Ser. No. 15/856,230, Filed Dec. 28, 2017, and entitled "Free Weight Bar Stabilizer", which is incorporated by reference herein in its entirety.

BACKGROUND OF INVENTION

Field of the Invention

The present invention relates to the field of free weight training devices, and more particularly to a device that stabilizes the free weight bar when being used in lifting and exercising.

Description of Related Art

Free weight training using a bar, with attached barbell plates, is the most desirable way to increase strength with all types of athletes, at all levels. A major challenge in working with free weights is to keep the bar stable while being used, particularly when loaded with numerous barbell plates. The bar tends to tip from side-to-side, and roll down the neck when performing certain routines, such as the "good morning". To compensate for unintended bar movement, the lifter must fight the bar to keep the loaded bar under control, and preferably will have other individuals act as "spotters" to prevent the bar from moving out of control, and possibly causing injuries.

Frequently, lifters work 'heavy negatives' to allow them to gradually work up to a heavier weight lifted. Sometimes, the lifter works with a desired weight through an initial portion of the routine, and then uses a lighter weight at a later portion of the routine. The lighter weight portion of the routine is then gradually reduced until the desired heavier weight is applied during the entire routine.

Other than chains or binds, there are no known devices available in the prior art to assist the lifter for incrementally adjusting the load during the performance of a routine.

As a consequence of the foregoing situation these has existed a longstanding need for a new and improved device for stabilizing a free weight bar, and the provision of such a construction is a stated objective of the present invention.

BRIEF SUMMARY OF THE INVENTION

Briefly stated, the present invention provides a free weight bar stabilizer, to be used with a standard size bar and attached barbell plates. The stabilizer includes beams pivotally attached to a frame at a pivot point so that it is angularly movable in an arc between a raised position and a lowered position, and a bar carriage attached to the beams so that it is linearly movable radially out from the pivot point between a retracted position and an extended position. The carriage includes spaced distal arms with attachment points for attaching the bar to support its opposing ends. The bar is thus freely movable within an envelope defined by the ranges of the simultaneous angular movement of the beam and the linear movement of the attachment points on the bar carriage. The free weight bar stabilizer may also include a carriage counterweight that simultaneously moves on the beam in the opposite direction of the bar carriage to counterbalance the weight of the bar carriage so it does not add to the quantity of the weight being lifted, and reduces pull or push of the bar carriage in or out. Further, the bar stabilizer may include an assisting weight mechanism to assist when working heavy negatives, by providing a counterweight to reduce the actual weight being lifted at a predetermined point, as the beam moves towards the lowered position. An alternate embodiment of the bar stabilizer includes pivoted main beams that are formed by spaced parallel rails that receive the bar and counterweight carriages in the spacing between the rails. This provides a clean, uncluttered design that maximizes the open area available to the lifter in the vicinity of the bar.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawing wherein.

DETAILED DESCRIPTION OF THE INVENTION

Figure 1:
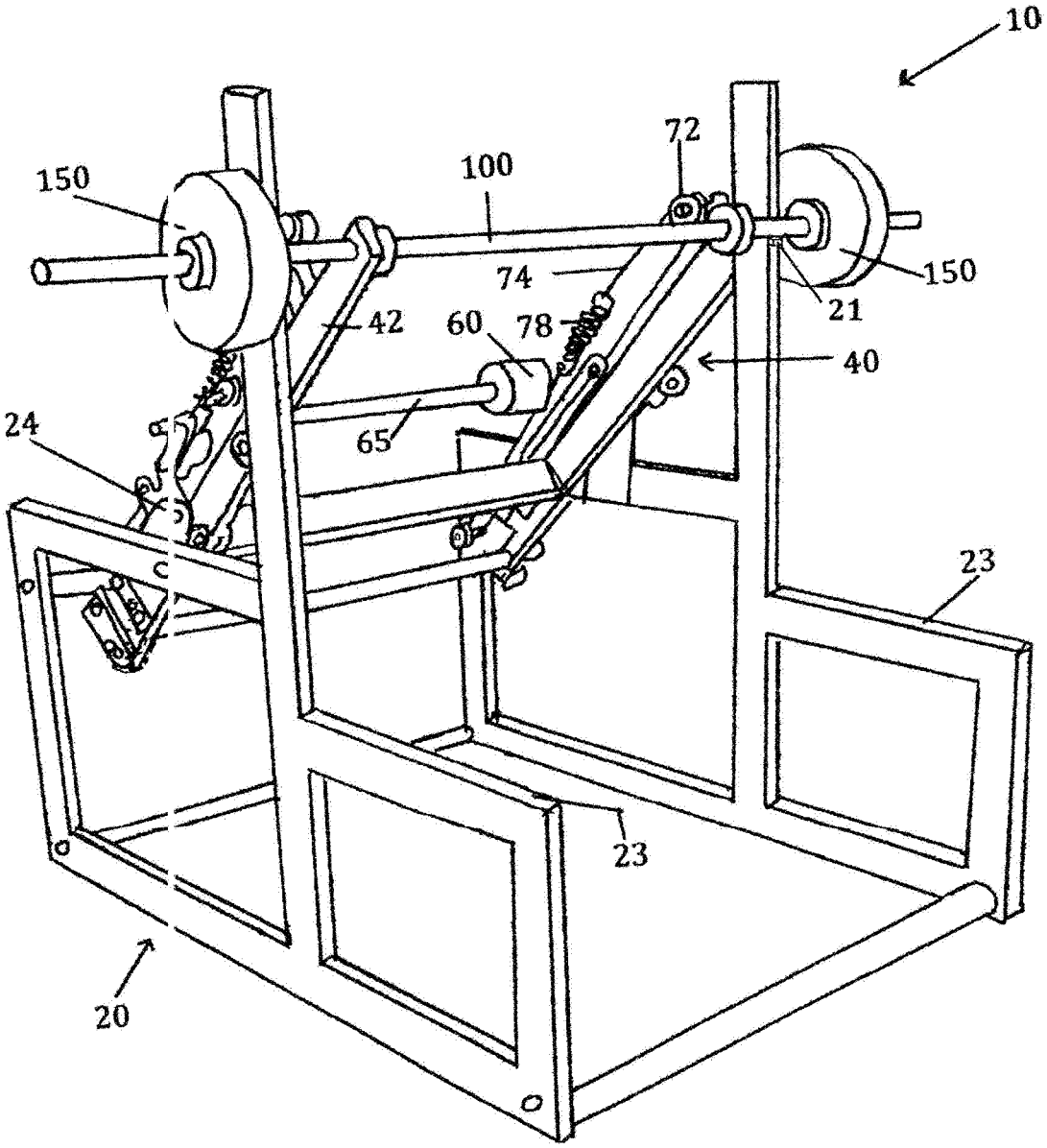
FIG. 1 is a perspective view of the free weight bar stabilizer of the present invention, showing the bar in a raised position supported it on a vertical frame member.
Figure 2:
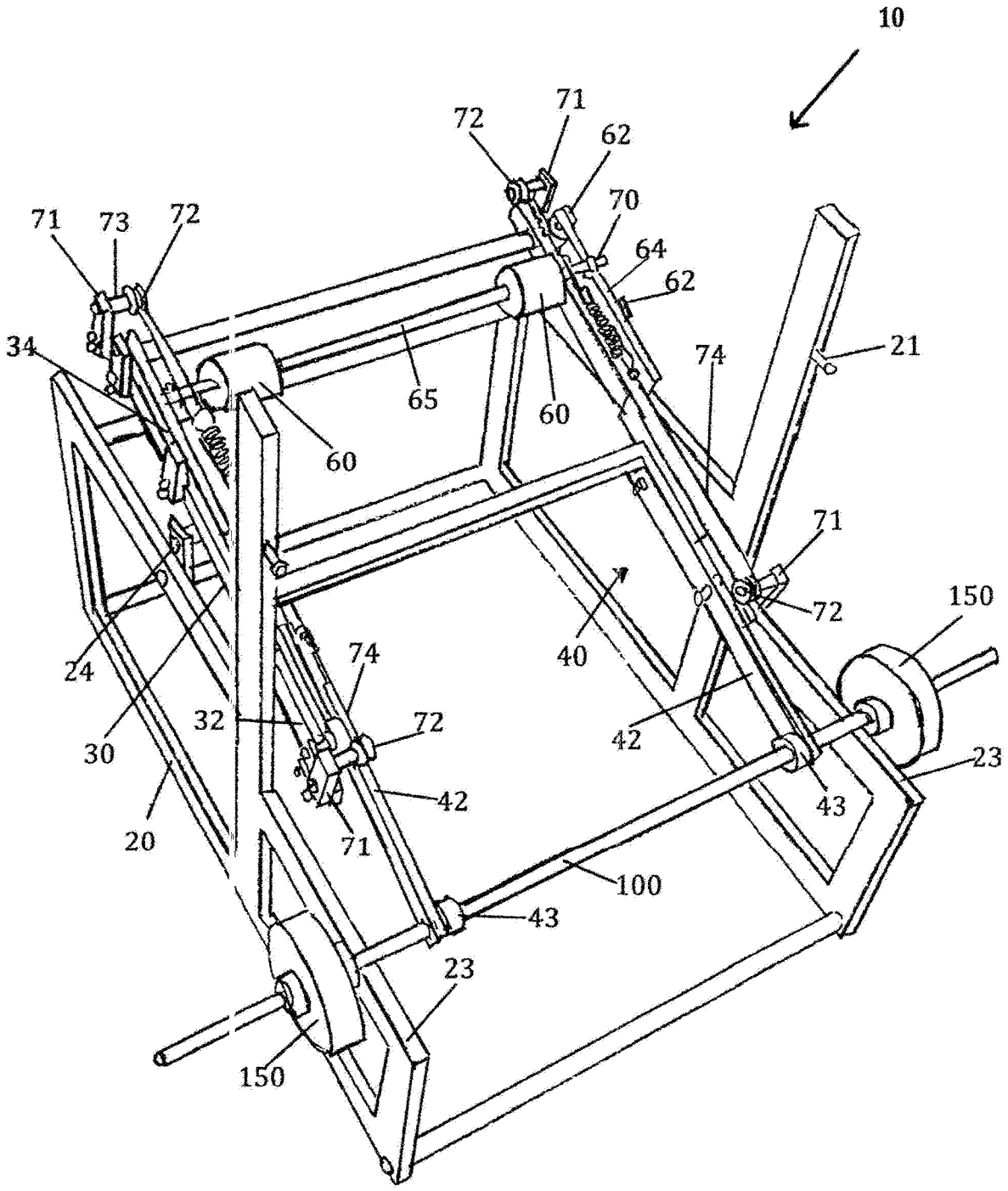
FIG. 2 is a perspective view similar to FIG. 1, but showing the bar in a lowered position resting on the spotting rail.

As can be seen by the reference to the drawings, and particularly to FIGS. 1 and 2, the free weight bar stabilizer that forms the basis of the present invention is designated generally by the reference number 10.

The bar stabilizer 10 includes a frame 20, a pair of main beams 30 pivotally attached to the frame 20, and a movable carriage 40 supported on the front section 32 of the beams 30. The stabilizer 10 shown in the drawings further includes a carriage counterweight 60 supported on the rear section 34 of the beams 30; and also includes an assisting weight mechanism 80. (not shown in FIGS. 1-2)

Figure 3:
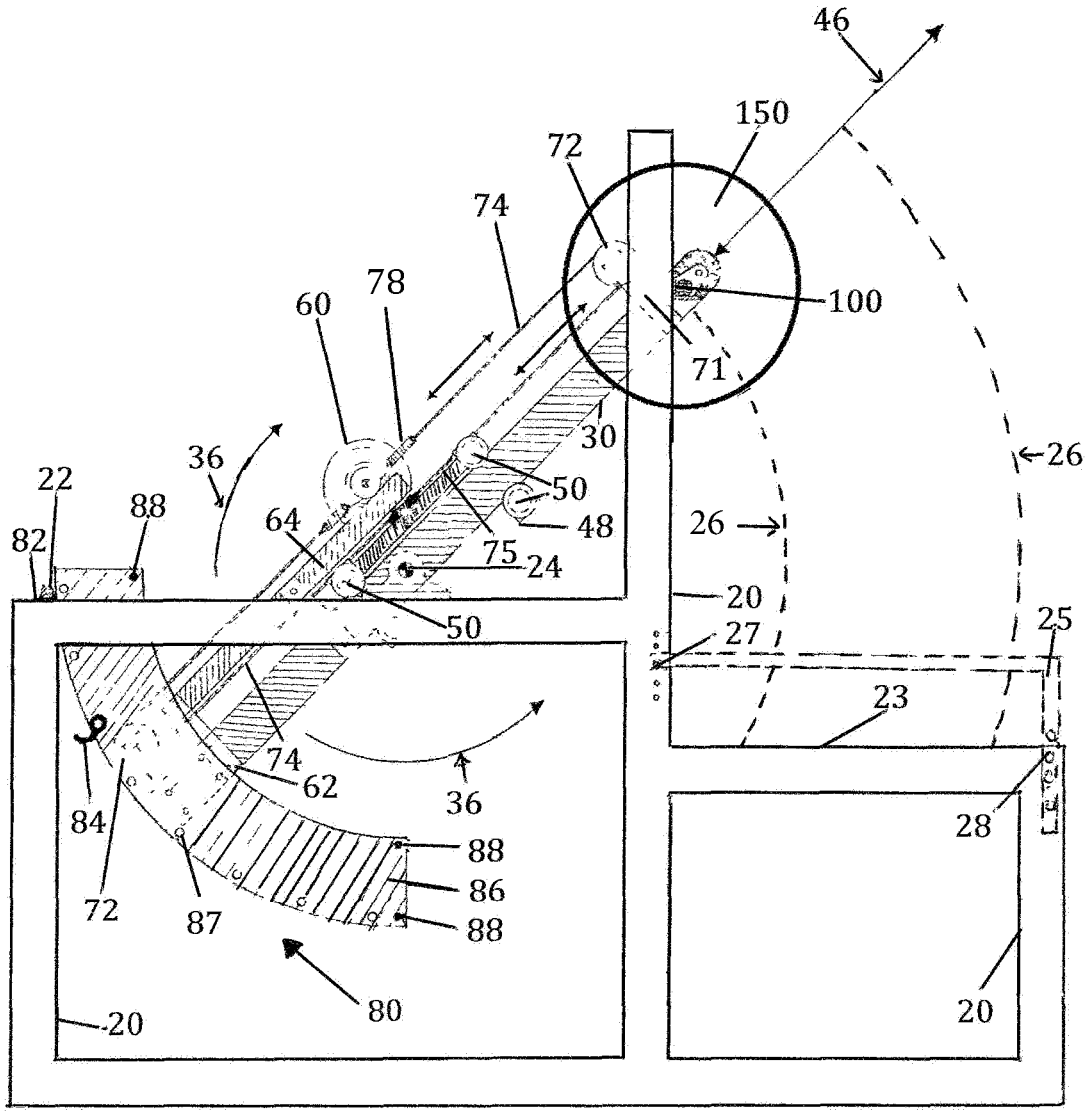
FIG. 3 is a side elevation view of the bar stabilizer.
Figure 4:
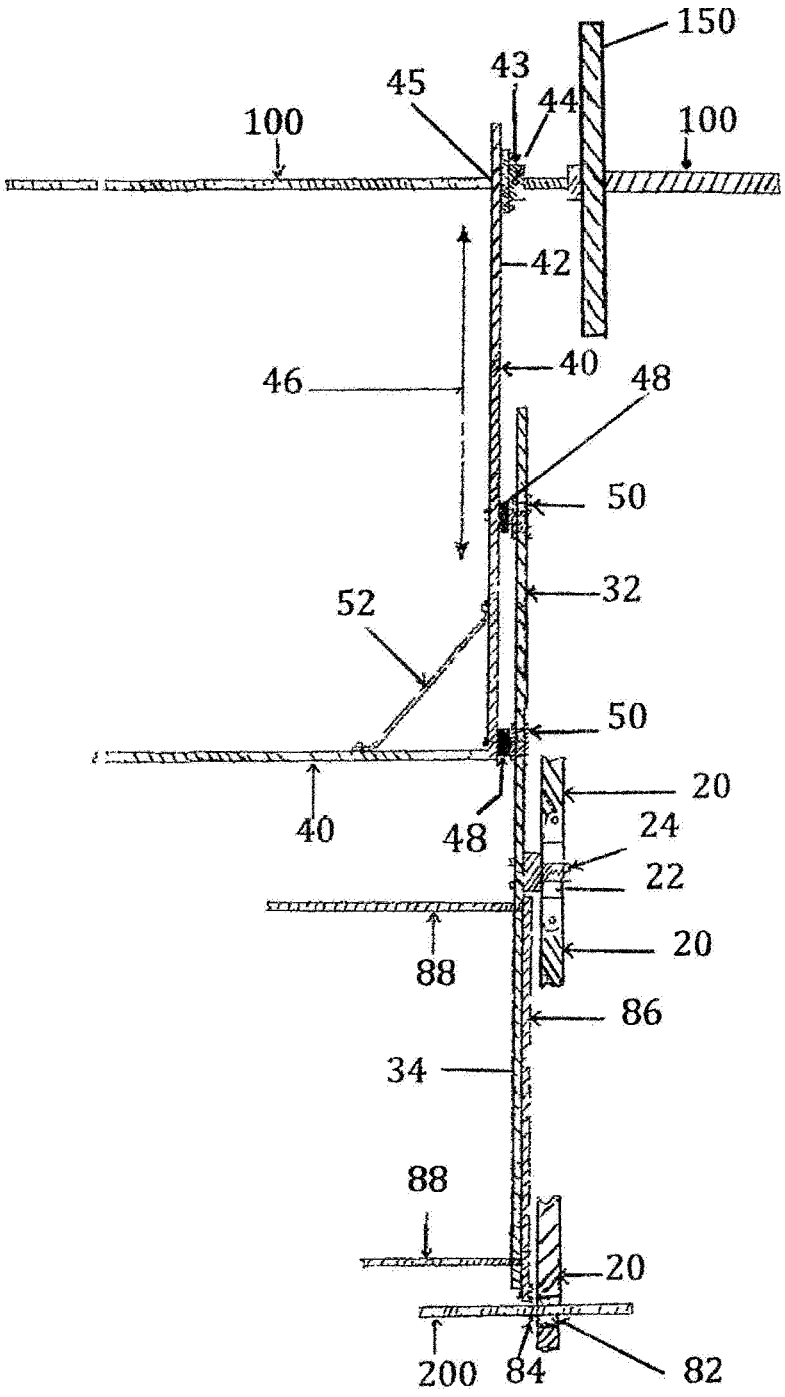
FIG. 4 is a partial plan view, with structure eliminated to clearly show the bar carriage supported on the front section of the main beams.
Figure 5:
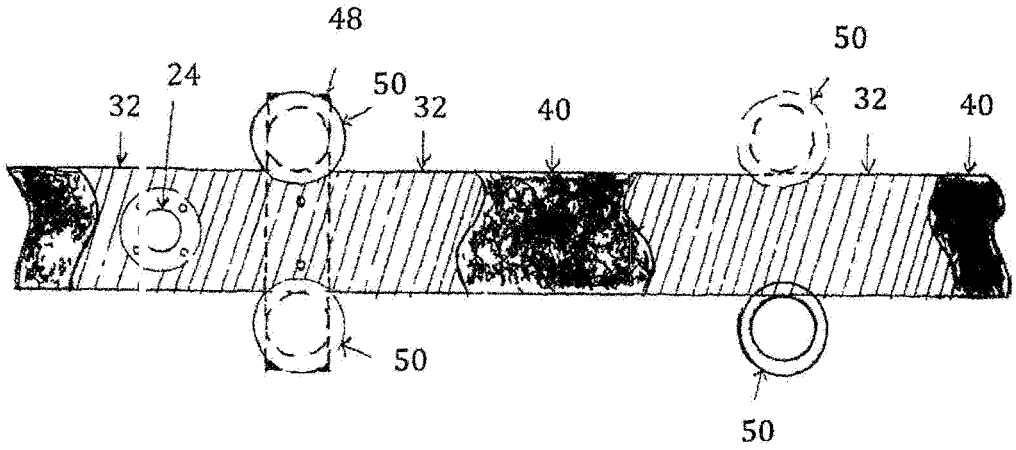
FIG. 5 is an enlarged partial side elevational view showing the front section of the beam carrying the roller assembly of the bar carriage.

As shown in FIGS. 3 and 4, the frame 20, at each lateral side, support a bearing 22 that receives a pivot shaft 24 disposed to rotate about a horizontal axis. The pivot shafts 24 are positioned on each side of the frame 20 at an elevation of about thirty-six inches, which approximates the position of the hip joint of an average person. A beam 30 is pivotally attached to each of the shafts 24 with a front section 32 and a rear section 34 located fore and aft of the shafts 24, respectfully. The beams 30 are disposed parallel to each other and move between a raised and lowered position in an arc shown by the directional arrow 36.

A linearly movable bar carriage 40 is received on the front section 32 of each of the beams 30. The bar carriage 40 includes horizontally spaced arms 42 that each have a bearing 43, with a set screw 44, attached adjacent a bar receiving opening 45 at the distal end of the arms 42. A roller assembly, that includes a roller bracket 48 carrying four rollers 50, is attached to and movably interconnects the front section 32 of each of the beams 30 and a rear portion of the bar carriage 40. A carriage brace 52 assists and keeping the carriage arms 42 parallel to the front section 32 of the beams 30. The bar carriage 40 is linearly movable radially out from the beams 30 between a retracted and extended position shown by the directional arrow 46. The combined angular range of motion of the beam 30, and the linear range of motion of the bar receiving opening 45 on each of the carriage arms 42, define the envelope of operation 26 of the free weight bar stabilizer 10.

In use, a standard Olympic bar 100 is placed through the opening 45 and the bearing set screws 44 are tightened. The desired weight is added by attaching and securing barbell plates 150 at the ends of the bar 100. The starting height of the bar 100 maybe anywhere in the envelope of operation 26.

FIG. 1 shows the bar 100 on a bar rest 21 attached to a vertical member of the frame 20 at a starting height of about fifty-four inches, which approximates the position of the shoulders and neck of the average lifter. The envelope of operation 26 shown has an upper limit defined by the location of the bar rest 21, and a lower limit defined by the spotting rail 23 that extends out from the front of the frame 20. If using the spotting rail 23 that is adjustable using pins 27 and holes 28, as shown in dashed lines, the envelope of operation 26 would be reduced.

It may be desirable to compensate for the weight of the bar carriage 40 that is acting on the lifter by providing a counterweight 60 that would balance the weight of the front and rear sections 32 and 34 of the beam 30. This would result in the lifter experiencing only the weight of the bar 100 and the attached barbell plates 150.

Figure 6:
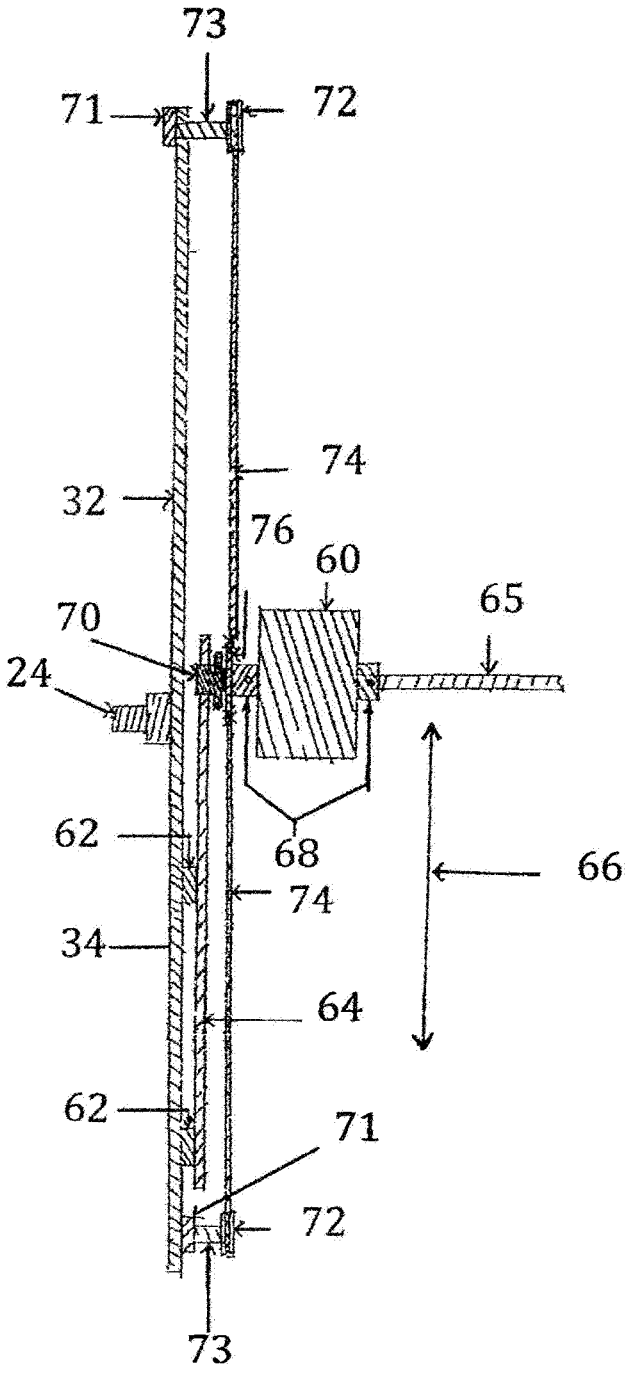
FIG. 6 is a partial plan view, with structure eliminated to clearly show the counterweight carriage supported on the rear section of the main beams, and to show the linkage that interconnects the bar carriage and the counterweight carriage.

As best shown in FIGS. 3 and 6, brackets 62 support a counterweight track 64 above and parallel to the rear section 34 of each of the beams 30. A shaft 65 extends transversely between the tracks 64, and carries a counterweight 60, secured by lock collars 68, interior of each of the tracks 64. A roller 70 is attached at each end of the shaft 65 to engage the tracks 64. Thus, the counterweights 60 are attached to the rear section 34 of the beams 30, and are movable between a forward position and a rearward position as indicated by the directional arrow 66. To further refine the balancing of weight on the front and rear sections 32 and 34 of the beam 30, a linkage is provided to interconnect the bar carriage 40 and counterweight 60. Using this linkage, as the bar carriage 40 moves from its retracted position to its extended position, the counterweight 60 simultaneously moves from its forward position to its rearward position.

Referring again to FIGS. 3 and 6, the linkage includes two pulleys 72, one attached to the front section 32 of the beams 30 and the other attached to the rear section 34 of the beams 30 by a pulley bracket 71 and a standoff 73. A front section of cable 74 has ends attached to an anchor 75 on the bar carriage 40, and to an anchor 76 on the counterweight 60. The cable 74 is trained over the pulley 72 at the front section 32 of the beams 30. A rear section of cable 74 is also attached to the anchors 75 and 76, and is trained over the pulley 72 at the rear section 34 of the beams 30. Springs 78 keep tension on the cable 74. The movement of the bar carriage 40 in one direction results in simultaneous movement of the counterweight 60 in the other direction to keep the beam 30 in balance. Thus, the lifter experiences only the weight of the bar 100 and the attached barbell plates 150.

At times it is desirable to change the amount of weight being lifted during the course of an exercise routine. An assisting weight mechanism 80 is provided that has an assisting weight bar rest 82 positioned at the rear of both sides of the frame 20. An assisting weight bar pick up hook 84 is carried on hook plate 86 attached to the rear section 34 of the beams 30. The hook plates 86 are connected by transverse tie bars 88 to keep them properly spaced and stabilized. Each of the hook plates 86 are arcuate in shape, and include a number of openings 87 spaced in an arcuate path along the rear edge of the plates 86. A selected one of the openings 87 on the hook plates 86 is adapted to selectively receive and support a pickup hook 84. Hooks 84, attached at the same elevation on each of the opposing plates 86, are disposed to engage and lift an assisting weight bar 200 up from the bar rest 82. When the assist bar 200, with any attached weights, is raised off the rest 82 the total weight picked up becomes a counterweight to the front section 32 of the beams 30 that carries the weight of the main bar 100 and attached barbell plates 150 being lifted. Thus, as the lifter bends down so that the main bar 100 on the bar carriage 40 moves towards the lowered position, the total weight being lifted is reduced by the predetermined point where the assist bar 200 is engaged by the hooks 84 and is raised. Changing the location of the pickup hooks 84 on the assist plates 86, changes the point where the total weight being lifted is changed.

The free weight bar stabilizer 10 of the present invention is particularly useful as the device for strengthening the posterior muscle chain through the 'good morning' and the 'Zercher' lift routines. Other exercises such as squats, deadlifts, shrugs and various bench routines may also be performed using the bar stabilizer 10. The assisting weight mechanism 80 assists the lifter when working 'heavy negatives', by reducing the weight being lifted at a particular point in a routine, to allow the lifter to gradually work up to a heavier desired weight.

In general, the bar stabilizer 10 allows the bar 100 to follow the lifter throughout the range of the movement within the working envelope of the bar 100. When performing the 'good morning' routine, the stabilizer 10 prevents the bar 100 from tipping from side to side, and also prevents the bar 100 from rolling down the lifter's neck when approaching the lowest point of movement in the routine. Since the bar 100 is completely stabilized, the lifter can achieve the full depth of the routine, and the risk of injury is greatly reduced.

An alternate embodiment 110, of the bar stabilizer 10, is illustrated in the drawings FIGS. 7-11. This embodiment of the bar stabilizer 110 includes a frame 120, a pair of main beams 130 pivotally attached to the frame 120, and a pair of movable bar carriages 140 supported on the front section 132 of the beams 130. The bar stabilizer 110 also includes a carriage counterweight 160 supported on the rear section 134 of the beams 130, and an assisting weight mechanism 180.

Figure 7:
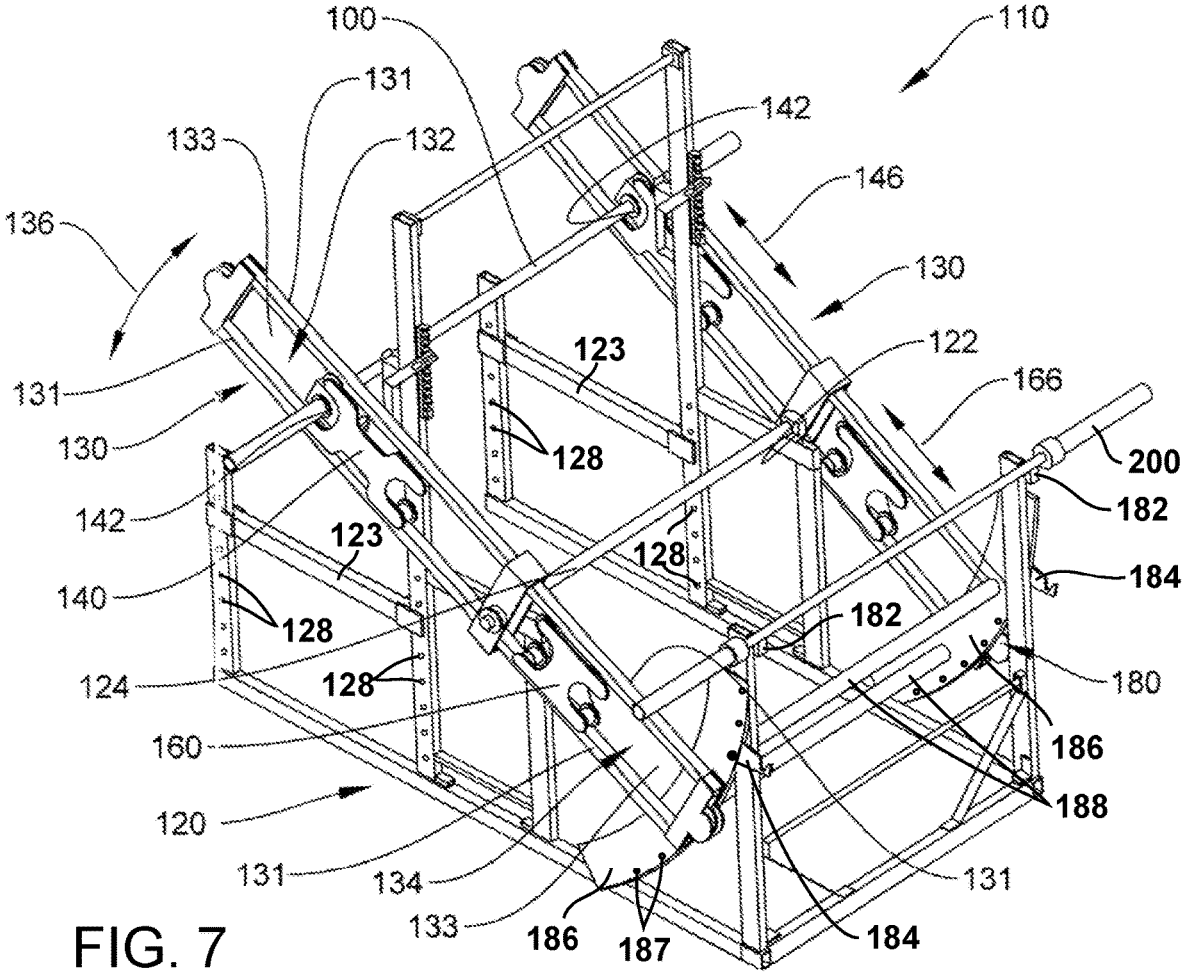
FIG. 7 is a perspective view of an alternate embodiment of the free weight bar stabilizer of the present invention, showing the bar in the raised position.
Figure 8:
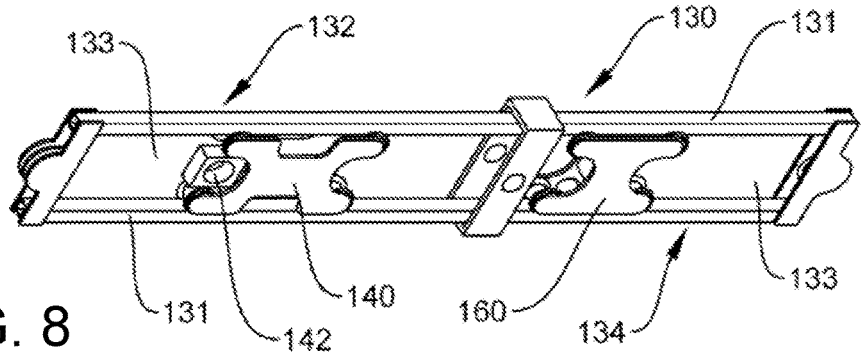
FIG. 8 is a perspective view of one of the main beams formed by spaced parallel rails, with the bar carriage and counterweight carriage moveably received in the spacing between the rails.
Figure 9:
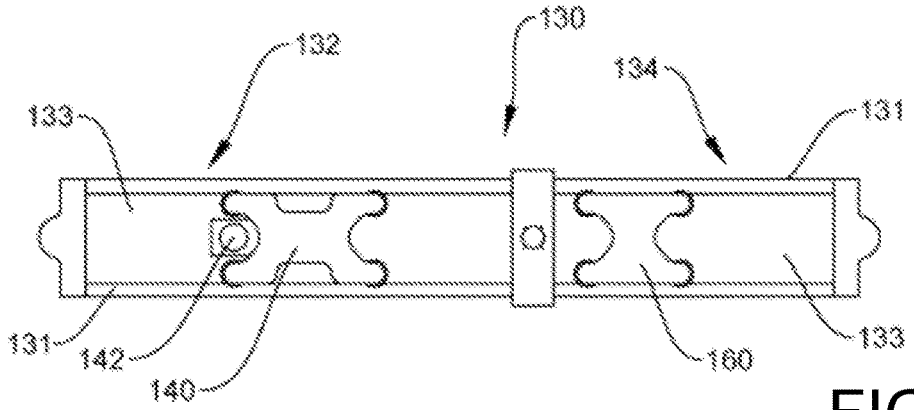
FIG. 9 is a side elevational view of one of the main beams.

As shown in FIG. 7, the frame 120, at each lateral side, supports a bearing 122 that receives a pivot shaft 124. Each of the beams 130 is pivotally attached to the shaft 124 with a front section 132 and a rear section 134 located fore and aft of the shaft 124, respectively. The beams 130 are disposed parallel to each other and move between a raised and a lowered position in arc shown by the directional arrow 136.

Each of the beams 130 is formed by space parallel rails 131 with a beam opening 133 between the rails 131. A linearly movable bar carriage 140 as received in the opening 133 of the front section 132, and a linearly movable counterweight carriage 160 is received in the opening 133 of the rear section 134.

Each bar carriage 140 includes an attachment point 142 that receives an end of standard Olympic bar 100. The bar carriage 140 is linearly movable in the opening 133 of the front section 132 between a retracted and extended position shown by directional arrow 146. The combined angular range of motion of the beam 130 indicated by directional arrow 136, and the linear range of motion of the attachment points 142 indicated by directional arrow 146, defines the envelope of operation of bar stabilizer 110.

As can be seen in FIG. 7, a positional lower limit is defined by a spotting rail 123 that extends out from the front of the frame 120. Adjusting a height of the spotting rail 123 using the various holes 128 provided, the lower limit of operation may be made to vary.

A counterweight carriage 160 can be used to compensate for the weight of the bar carried 140 so that the lifter will only bear the weight of the bar 100 and attached barbell plates. The counterweight carriage 160 is linearly movable in the opening 133 of the rear section 134 between a retracted an extended position indicated by directional arrow 166.

Figure 10:
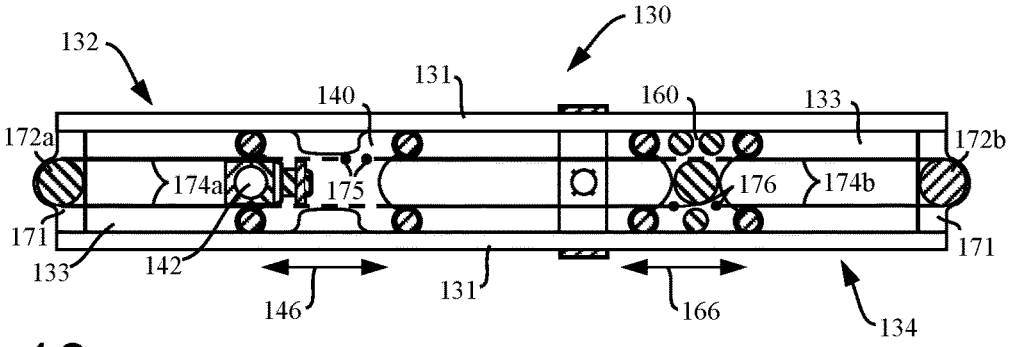
FIG. 10 is a side elevation sectional view similar to FIG. 9, but showing the cable linkage interconnecting the bar carriage and the counterweight carriage.
Figure 11:
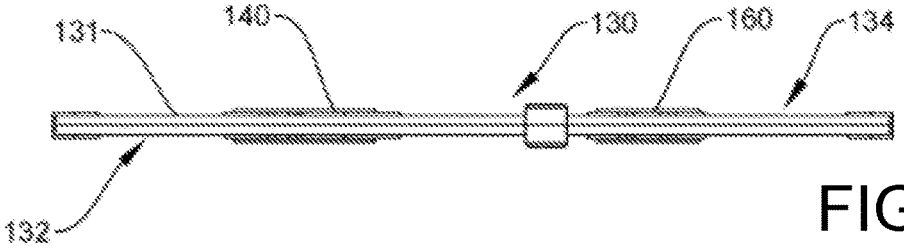
FIG. 11 is a top plan sectional view thereof.

FIGS. 10 and 11 illustrate a cable linkage that interconnects the bar carriage 140 and the counterweight carriage 160. The linkage is structurally similar to the linkage of the main embodiment of the present invention, and allows the bar carriage 140 to move from its retracted position to is extended position, while the counterweight carriage 160 simultaneously moves from its forward position to its rearward position. Thus, the bar stabilizer apparatus 110 is in balance regardless of the angular position of the beams 120 or the linear position of the bar and counterweight carriage is 140 and 160.

Referring again to FIGS. 7 and 10, the linkage includes two pulleys 172*a*, 172*b*, one attached to the front section 132 of the beams 130 and the other attached to the rear section 134 of the beams 130, each by a pulley bracket 171. A front cable 174*a* has ends attached to at least one anchor 175 on the bar carriage 140, and to at least one anchor 176 on the counterweight carriage 160. The front cable 174*a* is trained over the pulley 172*a* at the front section 132 of the beams 130. A rear cable 174*b* is also attached to the anchors 175 and 176, and is trained over the pulley 172*b* at the rear section 134 of the beams 130. The movement of the bar carriage 140 in one direction results in simultaneous movement of the counterweight carriage 160 in the other direction to keep the beam 130 in balance. Thus, the lifter experiences only the weight of the bar 100 and the attached barbell plates 150.

The assisting weight mechanism 180 is structurally similar to the assisting weight mechanism 80 of the first embodiment of the invention, and it functions in the same manner to reduce the weight being lifted at a predetermined point.

In particular, at times it is desirable to change the amount of weight being lifted during the course of an exercise routine. An assisting weight mechanism 180 is provided that has an assisting weight bar rest 182 positioned at the rear of both sides of the frame 120. An assisting weight bar pick up hook 184 is carried on a hook plate 186 attached to the rear section 134 of the beams 130. The hook plates 186 are connected by transverse tie bars 188 to keep them properly spaced and stabilized. Each of the hook plates 186 are arcuate in shape, and include a number of openings 187 spaced in an arcuate path along the rear edge of the plates 186. A selected one of the openings 187 on the hook plates 186 is adapted to selectively receive and support a pickup hook 184. Hooks 184, attached at the same elevation on each of the opposing plates 186, are disposed to engage and lift the assisting weight bar 200 up from the bar rest 182. When the assist bar 200, with any attached weights, is raised off the rest 182 the total weight picked up becomes a counterweight to the front section 132 of the beams 130 that carries the weight of the main bar 100 and attached barbell plates 150 being lifted. Thus, as the lifter bends down so that the main bar 100 on the bar carriage 140 moves towards the lowered position, the total weight being lifted is reduced by the predetermined point where the assisting weight bar 200 is engaged by the hooks 184 and is raised. Changing the location of the pickup hooks 184 on the assist plates 186, changes the point where the total weight being lifted is changed.

Although only an exemplary embodiment of the invention has been described in the detail above, those skilled in the art will readily appreciate that many modifications are possible without materially departing from the novel teachings and advantages of this invention. Accordingly, all such modifications are intended to be included with the scope of this invention as defined in the following claims.

The invention claimed is:

1. A free weight bar stabilizer, comprising;

a bar with barbell plates attached at opposing ends of the bar;

a frame;

a beam pivotally attached to the frame at a pivot point, and being disposed to pivot about a horizontal axis, the beam being pivotally movable between a raised position and a lowered position, the beam being formed by spaced parallel rails having an opening therebetween;

a bar carriage movably attached to the beam and being movable, within the beam opening, between a retracted position and an extended position, the bar carriage including a point of attachment disposed to selectively receive the bar;

wherein the bar is movable within an envelope partially defined by the point of attachment wherever the beam moves between its raised and lowered positions, and the carriage moves between its retracted and extended positions;

a counterweight carriage, wherein the beam includes a front section forward of the pivot point to which the bar carriage is attached, and a rear section rearward of the pivot point to which the counterweight carriage is attached;

wherein the counterweight carriage is movably attached to the rear section of the beam, and is movable between a forward position and a rearward position; and a linkage attached to and interconnecting the bar carriage and the counterweight carriage, wherein as the bar carriage moves from its retracted position to its extended position, the counterweight carriage simultaneously moves from its forward position to its rearward position.

2. The stabilizer of claim 1, further including an assisting weight bar positioned on the frame, and an assisting weight bar hook operably attached to the rear section of the beam disposed rearward of the pivot point, the assisting weight bar hook being disposed below the assisting weight bar, wherein the assisting weight bar hook engages and lifts the assisting weight bar at a predetermined point as the front section of the beam moves toward its lowered position.

3. The stabilizer of claim 2, further including a hook plate attached to the rear section of the beam and including a plurality of hook receiving points on the plate spaced above and below the beam, wherein the assisting weight bar hook is selectively received at one of the plurality of hook receiving points, and wherein the predetermined point where the assisting weight bar hook engages and lifts the assisting weight bar is determined by placement of the hook.

4. The stabilizer of claim 3, wherein the hook plate has an arcuate shape, and the plurality of hook receiving points are spaced in an arcuate path on the hook plate.

5. The stabilizer of claim 1, further including a spotting rail attached to the frame and being disposed at a lower section of the envelope.

6. The stabilizer of claim 5, wherein the spotting rail is vertically adjustable.

7. The stabilizer of claim 1, wherein the linkage includes a forward pulley attached to the front section of the beam, a rearward pulley attached to the rear section of the beam, a front cable carried on the forward pulley and being attached to and interconnecting the bar carriage and the counterweight carriage, and a rear cable carried on the rearward pulley and being attached to and interconnecting the bar carriage and the counterweight carriage.

8. A free weight bar stabilizer, comprising:

a bar with barbell plates attached at opposing ends of the bar;

a frame;

a beam pivotally attached to the frame at a pivot point, and being disposed to pivot about a horizontal axis, the beam being pivotally movable between a raised position and a lowered position, the beam being formed by spaced parallel rails having an opening therebetween;

a bar carriage movably attached to the beam and being movable, within the beam opening, between a retracted position and an extended position, the bar carriage including a point of attachment disposed to selectively receive the bar;

wherein the bar is movable within an envelope partially defined by the point of attachment wherever the beam moves between its raised and lowered positions, and the bar carriage moves between its retracted and extended positions; and an assisting weight bar positioned on the frame, and an assisting weight bar hook operably attached to the rear section of the beam disposed rearward of the pivot point, the assisting weight bar hook being disposed below the assisting weight bar, wherein the assisting weight bar hook engages and lifts the assisting weight bar at a predetermined point as the front section of the beam moves toward its lowered position.

9. The stabilizer of claim 8, further including a counterweight carriage, wherein the beam includes a front section forward of the pivot point to which the bar carriage is attached, and a rear section rearward of the pivot point to which the counterweight carriage is attached.

10. The stabilizer of claim 9, wherein the counterweight carriage is movably attached to the rear section of the beam and is movable between a forward position and a rearward position.

11. The stabilizer of claim 10, further including a linkage attached to and interconnecting the bar carriage and the counterweight carriage, wherein as the bar carriage moves from its retracted position to its extended position, the counterweight carriage simultaneously moves from its forward position to its rearward position.

12. The stabilizer of claim 11, wherein the linkage includes a forward pulley attached to the front section of the beam, a rearward pulley attached to the rear section of the beam, a front cable carried on the forward pulley and being attached to and interconnecting the bar carriage and the counterweight carriage, and a rear cable carried on the rearward pulley and being attached to and interconnecting the bar carriage and the counterweight carriage.

13. The stabilizer of claim 8, further including a hook plate attached to the rear section of the beam and including a plurality of hook receiving points on the plate spaced above and below the beam, wherein the assisting weight bar hook is selectively received at one of the plurality of hook receiving points, and wherein the predetermined point where the assisting weight bar hook engages and lifts the assisting weight bar is determined by placement of the assisting weight bar hook.

14. The stabilizer of claim 13, wherein the hook plate has an arcuate shape, and the plurality of hook receiving points are spaced in an arcuate path on the hook plate.

15. The stabilizer of claim 14, further including a spotting rail attached to the frame and being disposed at a lower section of the envelope.

16. The stabilizer of claim 15, wherein the spotting rail is a vertically adjustable.

* * * * *